US008129297B2

(12) United States Patent
Cleary et al.

(10) Patent No.: US 8,129,297 B2
(45) Date of Patent: Mar. 6, 2012

(54) METHOD AND APPARATUS FOR HEATING NONWOVEN WEBS

(75) Inventors: John C. Cleary, Hockessin, DE (US); Michael C. Davis, Midlothian, VA (US); Todd A. McCoy, Hendersonville, TN (US); Edgar N. Rudisill, Nashville, TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 1835 days.

(21) Appl. No.: 10/207,627

(22) Filed: Jul. 29, 2002

(65) Prior Publication Data

US 2004/0016143 A1 Jan. 29, 2004

(51) Int. Cl.
*D04H 1/00* (2006.01)

(52) U.S. Cl. ..... 442/361

(58) Field of Classification Search ..... 428/373; 442/361, 364, 374

See application file for complete search history.

(56) References Cited

U.S. PATENT DOCUMENTS

| | | | | |
|---|---|---|---|---|
| 3,585,733 | A | 6/1971 | Fleissner | |
| 3,748,747 | A | 7/1973 | Fleissner | |
| 3,973,417 | A | 8/1976 | Greer | |
| 4,145,819 | A | 3/1979 | Fleissner | |
| 4,657,804 | A * | 4/1987 | Mays et al. | 428/212 |
| 4,746,545 | A | 5/1988 | McIntyre | |
| 5,246,772 | A | 9/1993 | Manning | |
| 5,484,645 | A * | 1/1996 | Lickfield et al. | 428/198 |
| 5,906,877 | A * | 5/1999 | Popper et al. | 428/92 |
| 6,371,749 | B2 | 4/2002 | Thompson et al. | |
| 2004/0002273 | A1 * | 1/2004 | Fitting et al. | 442/351 |
| 2004/0034942 | A1 * | 2/2004 | Cleary et al. | 8/115.51 |
| 2004/0040179 | A1 * | 3/2004 | Cleary et al. | 34/611 |
| 2004/0045186 | A1 * | 3/2004 | Cleary et al. | 34/391 |
| 2004/0097158 | A1 * | 5/2004 | Rudisill et al. | 442/401 |

FOREIGN PATENT DOCUMENTS

| | | | |
|---|---|---|---|
| DE | 16 35 334 | A | 11/1970 |
| DE | 32 41 519 | A | 5/1984 |
| GB | 830 989 | A | 3/1960 |
| GB | 1 060 689 | A | 3/1967 |

OTHER PUBLICATIONS

"Sit Back and Relax", The International Dyer, 2000, pp. 27-, 185/3.
Robert J. Poterala, "The Importance of Air Levitation in Drying High Quality Coated Fabrics", Journal of Coated Fabrics, Jan. 1996, pp. 190-204, vol. 25, Technomic Publishing Co., Inc.

* cited by examiner

*Primary Examiner* — Arti Singh-Pandey

(57) ABSTRACT

A process for drying/heat-treating nonwoven webs in which the web is partially dried under tension in a first drying zone and further heat treated under low tension or in a substantially tensionless state a second drying zone. The process significantly reduces the occurrence of stretch-type defects in the nonwoven webs.

7 Claims, 1 Drawing Sheet

METHOD AND APPARATUS FOR HEATING NONWOVEN WEBS

BACKGROUND OF THE INVENTION

1. Field of the Invention

This invention relates to a method and apparatus for heat-treating nonwoven webs.

2. Description of Related Art

Methods for drying and heat-treating sheet-type materials such as nonwoven, knitted, and woven fabrics are known in the art. For example, air-impingement and flotation dryers are known in the art that are suitable for drying sheet materials that can tolerate the relatively high tensions used to pull the sheet through the process. Porous sheet materials can also be heated while under low or substantially zero tension by pulling a heated gas, such as air, through the fabric while pinning the fabric to a porous surface such as a drum or belt. For example, in a through-air bonder hot air on one side of a sheet is pulled through the sheet by applying a vacuum to the opposite side, the vacuum also serving to pin the sheet to a porous surface on which the sheet is supported. It is also known to remove residual water from a nonwoven fabric that has been topically treated with a chemical finish composition by passing the fabric over steam cans.

An air levitation dryer developed by Mascoe for processing coated webs is described in *Journal of Coated Fabrics*, Vol. 25, January 1996, pp. 190-204. The levitation system is described as having the ability to support webs up to 60 inches wide and 50 feet in length without using a transport conveyor or tenter and with no contact to any supporting surface using no more than 10 pounds lineal tension. Such dryers have the limitation that they are not readily adapted to high processing speeds. Other low-tension dryers are disclosed in *International Dyer,* 185, Number 3, p. 27 (March, 2000). In one example, a fabric is transported in a tensionless state using a conveyor belt and overfeeding the fabric, alternating between sections where the fabric is run in a wave by means of alternate upper and lower air flows and sections where suction is performed under the belt.

However, known drying processes can cause defects to form in the nonwoven webs during the drying process, such as waves or puckers in the fabric sheet, especially when the polymeric fiber component(s) in the fabric are relatively low-melting temperature materials.

It would be advantageous to be able to dry and/or cure chemical finishing agents applied to a nonwoven web or sheet which comprises relatively low-melting temperature polymeric fiber components, or otherwise heat-treat such a nonwoven web or sheet, without creation of defects in the dried nonwoven sheet or web.

SUMMARY OF THE INVENTION

In a first embodiment, the invention is directed to a method for drying a nonwoven fabric that has applied thereon a chemical finish composition comprising the steps of providing a nonwoven fabric comprising thermoplastic polymeric fibers and containing a chemical finish composition comprising a solvent and at least one chemical agent; applying tension to the nonwoven fabric and transporting the fabric containing the chemical finish composition through a first drying zone wherein the solvent content of the nonwoven fabric is reduced to no less than about 2 weight percent, based on the dry weight of the nonwoven fabric, as the nonwoven fabric exits the first drying zone; transferring the nonwoven fabric from the first drying zone to a second drying zone, wherein the tension applied to the nonwoven fabric in the second drying zone is less than the tension applied to the nonwoven fabric in the first drying zone; heating the nonwoven fabric in the second drying zone to substantially completely remove the solvent from the nonwoven fabric; and cooling the nonwoven fabric in a cooling zone.

In another embodiment, the invention is directed to a method for heat treating a multiple component nonwoven fabric comprising a first polymeric component and a second polymeric component, the first polymeric component having a melting point or softening point that is lower than the melting point or softening point of the second polymeric component, comprising heating the nonwoven fabric to a temperature that is greater than about $(T_m-40)°$ C., where $T_m$ is the melting or softening point of the first polymeric component, but less than about $(T_m-10)°$ C. while the nonwoven fabric is under a tension in any one direction that is between 0 and 52.5 N/m.

Another embodiment of the invention is directed to an apparatus for heat-treating a sheet material comprising a first heating zone; a second heating zone; and a tension isolation means disposed between the first and second heating zones, wherein the tension isolation means applies tension to the sheet as it is conveyed through the first heating zone and causes a reduction in tension on the sheet as the sheet exits the tension isolation means and is conveyed through the second heating zone.

Another embodiment of the invention is directed to a nonwoven fabric comprising fibers which comprise polyethylene, the nonwoven fabric having a chemical agent applied thereon and having a Frazier air permeability of at least 5 $m^3/min/m^2$ and characterized by less than 1.2 stretch-type defects/$m^2$.

DETAILED DESCRIPTION OF THE INVENTION

Figure 1:
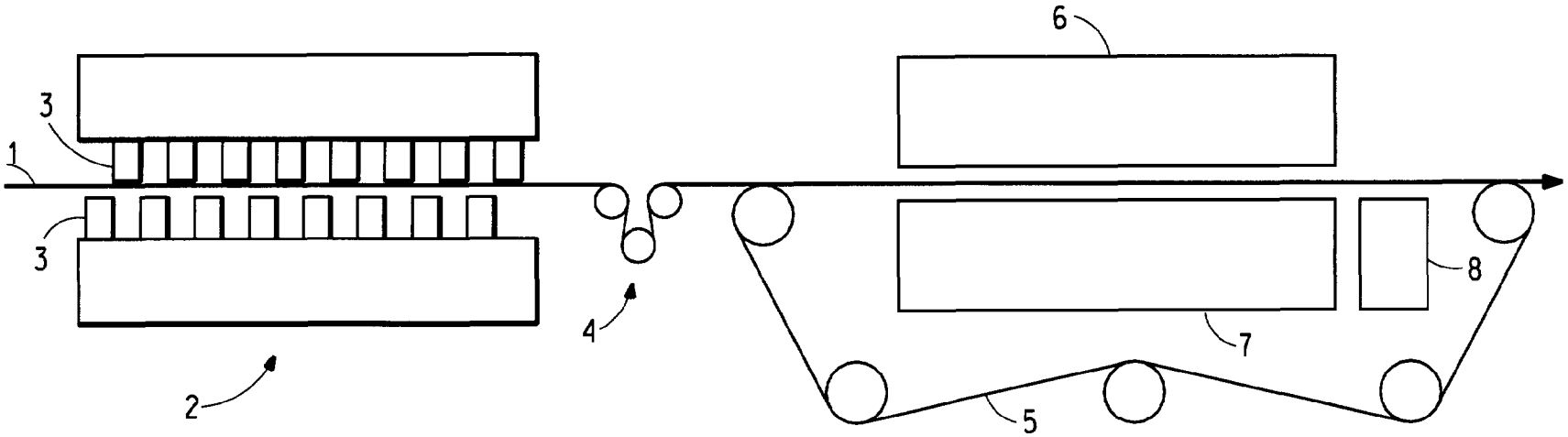
FIG. 1 is a schematic drawing of a side view of an apparatus suitable for carrying out a drying process according to an embodiment of the present invention.

It has been found that heating a nonwoven fabric made from thermoplastic polymeric fibers while the nonwoven fabric is under tension can cause the formation of defects that appear as waves or puckers in the fabric. For example air-impingement and flotation dryers as well as processes utilizing steam cans require that tension be applied in the machine direction as the heated fabric is pulled through or removed from the process. Through-air bonding processes which apply suction to the fabric and pin the fabric to a porous surface during heating, while resulting in substantially no tension in the plane of the fabric, require that the sheet have sufficient porosity to allow air to be pulled through the sheet. Further problems arise when using through-air processes to dry nonwoven fabrics having low air permeability, for example a SMS (spunbond-meltblown-spunbond) composite nonwoven fabric, which has been topically treated with a chemical finish composition. The flow of heated gas through such fabrics generally results in loss of part of the finish as the heated gas is blown or pulled through the fabric.

The present invention relates to a process that is suitable for drying nonwoven fabrics having relatively low air permeability that have been topically treated with a chemical finish composition. The process does not cause formation of stretch-type defects and also does not cause any substantial loss of the topically applied chemical agent during drying.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. Examples of polyesters include poly(ethylene terephthalate) (PET), which is a condensation product of ethylene glycol and terephthalic acid, and poly(trimethylene terephthalate), which is a condensation product of 1,3-propanediol and terephthalic acid.

The term "polyethylene" as used herein is intended to encompass not only homopolymers of ethylene, but also copolymers wherein at least 85% of the recurring units are ethylene units.

The term "linear low density polyethylene" (LLDPE) as used herein refers to linear ethylene/α-olefin co-polymers having a density of less than about 0.955 g/cm$^3$, preferably in the range of 0.91 g/cm$^3$ to 0.95 g/cm$^3$, and more preferably in the range of 0.92 g/cm$^3$ to 0.95 g/cm$^3$. Linear low density polyethylenes are prepared by co-polymerizing ethylene with minor amounts of an alpha,beta-ethylenically unsaturated alkene co-monomer (α-olefin), the a-olefin co-monomer having from 3 to 12 carbons per α-olefin molecule, and preferably from 4 to 8 carbons per α-olefin molecule. Alpha-olefins which can be co-polymerized with ethylene to produce LLDPE's useful in the present invention include propylene, 1-butene, 1-pentene, 1-hexene, 1-octene, 1-decene, or a mixture thereof. Preferably, the α-olefin is 1-hexene or 1-octene. Such polymers are termed "linear" because of the substantial absence of branched chains of polymerized monomer units pendant from the main polymer "backbone".

The terms "nonwoven fabric" and "nonwoven web" as used herein mean a structure of individual fibers, filaments, or threads that are positioned in a random manner to form a planar material without an identifiable pattern, as opposed to a knitted fabric. Examples of nonwoven fabrics and webs include spunbond continuous filament webs, meltblown webs, carded webs, air-laid webs, and wet-laid webs.

The term "meltblown fibers" as used herein, means fibers that are formed by meltblowing, which comprises extruding a melt-processable polymer through a plurality of capillaries as molten streams into a high velocity gas (e.g. air) stream. The high velocity gas stream attenuates the streams of molten thermoplastic polymer material to reduce their diameter and form meltblown fibers having a diameter between about 0.5 and 10 microns. Meltblown fibers are generally discontinuous fibers but can also be continuous. Meltblown fibers carried by the high velocity gas stream are generally deposited on a collecting surface to form a meltblown web of randomly dispersed fibers.

The term "spunbond" fibers as used herein means fibers which are formed by extruding molten thermoplastic polymer material as fibers from a plurality of fine, usually circular, capillaries of a spinneret with the diameter of the extruded filaments then being rapidly reduced by drawing and quenched. Other fiber cross-sectional shapes such as oval, multi-lobal, etc. can also be used. Spunbond fibers are generally continuous filaments and have an average diameter of greater than about 5 microns. Spunbond nonwoven webs are formed by laying spunbond fibers randomly on a collecting surface such as a foraminous screen or belt using methods known in the art. Spunbond webs may be bonded using methods known in the art such as by thermally point bonding the web at a plurality of discrete thermal bond points, lines, etc. located across the surface of the spunbond web.

The term "multiple component fiber" as used herein refers to any fiber that is composed of at least two distinct polymeric components, that have been spun together to form a single fiber. As used herein the term "fiber" includes both continuous filaments and discontinuous (staple) fibers. By the term "distinct polymeric components" it is meant that each of the at least two polymeric components are arranged in distinct substantially constantly positioned zones across the cross-section of the multiple component fibers and extend substantially continuously along the length of the fibers, for example in a side-by-side, sheath-core, wedge, hollow wedge, or other segmented-type cross-section known in the art. The polymeric components in multiple component fibers may be chemically different or they may have the same chemical composition but differ in isomeric form, crystallinity, shrinkage, elasticity, molecular weight or other property. Multiple component fibers are distinguished from fibers that are extruded from a single homogeneous melt blend of polymeric materials in which zones of distinct polymers are not formed. However, one or more of the polymeric components in the multiple component fiber can be a blend of different polymers.

The term "multiple component nonwoven fabric" as used herein refers to a nonwoven fabric comprising multiple component fibers. The process of the current invention is especially suitable for heat treatment of multiple component nonwoven fabrics that include a low-melting polymeric component and a high-melting polymeric component. The low-melting polymeric component preferably has a melting point that is at least 10° C. less than the melting point of the high melting polymeric component. For example, the nonwoven fabric can be a bicomponent nonwoven fabric comprising bicomponent fibers.

Examples of polymer combinations suitable for preparing bicomponent nonwoven fabrics include polyester/polyethylene, polypropylene/polyethylene, and polyamide/polyethylene. Examples of polyester/polyethylene polymer combinations include poly(ethylene terephthalate)/linear low density polyethylene and poly(trimethylene terephthalate)/linear low density polyethylene. The ratio of the two polymeric components in each fiber is generally between about 10:90 to 90:10 based on volume (for example measured as a ratio of metering pump speeds), preferably between about 30:70 to 70:30, and most preferably between about 40:60 to 60:40.

The term "stretch-type defect" is used herein to describe defects that occur in a nonwoven fabric when tension is applied to the fabric while the fabric is being heated. Stretch-type defects appear as waves or puckers in the fabric that are typically about 2.5 to 5.0 centimeters long with the length of the defect generally being aligned with the direction the tension is applied during heating. For example, when the defect is formed by tension applied to the fabric in the machine direction, such as would occur in processes wherein the fabric is pulled through the heating process in the machine direction, the pucker will be longer, or oriented in, the machine direction. If a process is used which applies cross-direction tension to the fabric, such as in a tenter frame process, the defects can be formed with a cross-direction orientation. As the tension applied to the fabric during heating increases, the defects become more pronounced and the amplitude and frequency of the wave-like defects increase. Formation of stretch-type defects may be accompanied by a decrease in the dimension of the nonwoven fabric perpendicular to the direction the tension is applied.

The term "serpentine rolls" is used herein to refer to a series of two or more rolls that are arranged with respect to each other such that a nonwoven web or other sheet-type material may be directed under and over sequential rolls and in which alternating rolls are rotating in opposite directions.

FIG. 1 is a schematic diagram illustrating an embodiment of the process and apparatus of the current invention. Nonwoven fabric 1 comprising thermoplastic polymeric fibers, which has been topically treated with a chemical finish composition comprising a solvent and a chemical agent, is transported from a chemical treatment process (not shown), such as a dip-squeeze process, through a first drying zone. Throughout this specification, references to a 'drying zone' are intended to include, but not be limited to a heating zone, wherein a heat source is incorporated to aid drying or otherwise heat-treating the fabric. Likewise, drying can be effected by other means, such as vacuum evaporation or other such methods known in the art.

Examples of chemical agents used in topically applied finish compositions include fluorochemicals, flame-retardants, wetting agents, binders, antistatic agents, and colorants. More than one chemical agent can be contained in the finish composition. The solvent is used to dissolve and/or disperse the chemical agent(s) to form a finish composition that is applied to the nonwoven fabric. The solvent generally comprises one or more volatile compositions that are capable of being removed by heating in the process of the current invention. In the embodiment shown in FIG. 1, the first drying zone includes air-impingement flotation dryer 2. Hot air is blown from a plurality of air supply slots 3 located on both sides of the fabric. The impinging air streams cause the fabric to float as it is pulled through the dryer by tension applied to the fabric by a set of three serpentine rolls 4. The hot air causes the solvent from the chemical finish composition to evaporate as the fabric is transported through dryer 2. As the solvent evaporates, the fabric temperature remains relatively low compared to the temperature of the hot air due to the heat of vaporization of the solvent. If the solvent were allowed to evaporate completely in the first drying zone, the temperature of the fabric would rise rapidly to the temperature of the hot air in the dryer. It is important in the process of the current invention that the solvent not be completely removed in the first drying zone so that the temperature of the web does not rise so high as to cause the formation of stretch-type defects. For example, attempts to substantially completely dry a composite SMS nonwoven fabric in which the spunbond fibers comprised a linear low density polyethylene sheath and a polyester core in a flotation dryer using a hot air temperature of 200° F. (93° C.) resulted in formation of stretch-type defects. This was surprising since it was expected that the higher-melting polyester core component of the bicomponent spunbond fibers would prevent formation of stretch-type defects under such conditions.

As the nonwoven fabric exits the first drying zone it contains at least 2 weight percent solvent, calculated based on the dry weight of the nonwoven fabric. Preferably the nonwoven fabric contains between about 2 to 40 weight percent solvent, more preferably between about 2 to 20 weight percent solvent, and most preferably between about 5 and 15 weight percent solvent as it exits the first drying zone. Sufficient solvent is preferably evaporated in the first drying zone so that the air permeability of the fabric exiting the first drying zone is increased sufficiently that the partially-dried nonwoven fabric can be subjected to a through-air type process without substantial loss of chemical agent from the fabric. Fabrics suitable for use in a through-air process generally have a Frazier air permeability of 5 $m^3/min/m^2$ or higher.

Because the temperature of the nonwoven fabric remains relatively low as long as the nonwoven fabric comprises at least 2 weight percent solvent, the fabric can be subjected to relatively high tensions in the first drying zone without causing formation of stretch-type defects. For example, tensions greater than 0.3 pounds/linear inch (52.5 N/m), in some cases greater than 0.4 pounds/linear inch (70.1 N/m), or greater than 0.5 pounds/linear inch (87.6 N/m) can be used in the first drying zone, where the tension is calculated as the force applied to the fabric divided by the width of the fabric. If the nonwoven web is allowed to reach a temperature that is greater than about $(T_m-30)$° C., where $T_m$ is the melting or softening point of the lowest-melting polymeric component (or the only polymeric component in the case of a monocomponent fiber), and in some cases greater than about $(T_m40)$° C., stretch-type defects can form at tensions as low as 0.3 pounds/linear inch (52.5 N/m).

Other drying means can be used in the first drying zone instead of or in addition to the air-impingement flotation dryer shown in FIG. 1. For example, a tenter frame apparatus can be used in which the fabric is attached to a frame via pins along its edges and hot air impinged on one or both sides of the fabric. Instead of hot air, the fabric can be heated using a series of infrared heaters or by passing it through a region where microwave energy is used to evaporate the solvent (e.g. water). Alternately, the fabric can be wrapped around heated solid drums such as steam cans.

The drying means employed in the first drying zone is preferably chosen so as to not result in substantial loss of the chemical agent applied to the nonwoven fabric. The fabric exiting the first drying zone preferably contains at least 80 percent, more preferably at least about 95 percent, most preferably at least about 98 percent of the total chemical agent initially contained therein when the fabric entered the first drying zone. If the nonwoven fabric containing the topical finish treatment has low air permeability as it enters the first drying zone, through-air drying methods are generally not suitable for use in the first drying zone because part of the chemical finish composition will be forced out of the fabric as air is passed through the wet fabric. While very low air flows may be used in a through-air drying process, it would result in a very large and inefficient dryer.

In addition to providing tension to pull the nonwoven fabric through the first drying zone, serpentine rolls 4 also function as a tension-isolation means. The term "tension isolation means" is used herein to describe a means for reducing or removing the tension on the fabric so that the fabric exiting the tension isolation means has a lower tension applied thereto than the fabric entering the tension isolation means. The tension on the fabric exiting the tension isolation means is preferably at least 50% less than the tension that is applied to the fabric as it enters the tension isolation means. Alternate tension isolation means include a nip formed between two rolls. Use of a nip to isolate the tension on the web is generally suitable if the nonwoven fabric has been sufficiently dried so that passing the fabric through the nip does not result in substantial amounts of finish being squeezed out of the fabric.

As the partially dried nonwoven fabric exits the serpentine rolls, it is transported through a second drying zone at tensions no greater than 0.3 pounds/linear inch (52.5 N/m), preferably no greater than about 0.1 pounds per linear inch (17.5 N/m). The tension in any direction in the plane of the fabric in the second drying zone is preferably as close to zero N/m as possible.

In the embodiment shown in FIG. 1, the partially dried nonwoven fabric exiting the serpentine rolls is contacted with porous belt 5 and transported through a second drying zone, which includes vacuum belt dryer 6. Hot air provided from blowers above the fabric is pulled through the fabric by vacuum source 7 located beneath the fabric. The suction provided by the vacuum causes the nonwoven fabric to be pinned to the porous belt so that the nonwoven fabric is transported through the second drying zone while it is pinned to the belt with substantially no tension being applied in the plane of the fabric. The solvent remaining in the nonwoven fabric is substantially completely removed in the second drying zone and the temperature of the fabric is allowed to rise to temperatures approaching or equal to the temperature of the heated air in the dryer. Because the air permeability of the fabric increases in the first drying zone as a result of solvent evaporation, the flow of heated air through the fabric in the second drying zone does not result in any substantial decrease in the amount of chemical agent contained in the nonwoven fabric. The fabric exiting the second drying zone contains at least 95 percent, more preferably at least 98 weight percent, of the chemical agent contained therein when the fabric entered the second drying zone.

The second drying zone may also function as a curing zone if the chemical agent applied to the nonwoven fabric is a curable material, such as a fluorochemical. In that case, the fabric is heated to a sufficient temperature for a sufficient time to cure the curable material in the second drying zone. As used herein, the term "cure" refers to heat treatment of a nonwoven fabric under conditions which complete the polymerization reaction of, or otherwise modify, a chemical agent contained within the chemical finish composition that was applied to the nonwoven fabric. For example, the heat treatment may cause re-orientation of the chemical agent molecules on the surface of the fabric or cross-linking of the chemical agent. Curing results in an improvement in the performance of the chemical agent or imparts desired properties to the nonwoven fabric. For example, when the chemical agent is a curable fluorochemical, curing results in an improvement in the water and alcohol repellency of the nonwoven fabric compared to the nonwoven fabric containing the uncured fluorochemical.

Other drying means can be used in the second drying zone instead of or in addition to the through-air type dryer shown in FIG. 1. For example, a tenter frame could be used by adjusting the pin width and supporting the fabric by blowing air from underneath so that tension in the cross-direction is no greater than 0.3 lb./linear inch (52.5 N/m), preferably no greater than 0.1 lb./linear inch (17.5 N/m).

Because the fabric is subjected to low tension in the second drying zone, the temperature of the fabric in the second drying zone can be increased to temperatures that would result in formation of stretch-type defects in the fabric at higher tensions. For example the nonwoven fabric can be heated to temperatures greater than about $(T_m-40)°$ C., where $T_m$ is the melting or softening point of the lowest-melting (or only) polymeric component in the nonwoven fabric, in some cases temperatures greater than about $(T_m-30)°$ C., without formation of stretch-type defects. Unlike through-air bonding processes, the temperature of the nonwoven fabric in the second drying zone is significantly less than the melting point of the lowest-melting polymeric component. The nonwoven fabric is not heated so high as to cause any further bonding between the fibers of the nonwoven fabric by softening or melting of the lowest melting polymeric component in the fibers of the nonwoven fabric. This is different from a through-air bonding process in which the nonwoven fabric would be heated to temperatures sufficiently high to cause bonding between the fibers due to the melting or softening of the lowest-melting polymeric component. The temperature of the fabric in the second drying zone is preferably less than about $(T_m-5)°$ C., more preferably less than about $(T_m-10)°$ C., and in some cases less than about $(T_m-15)°$ C.

As the dried fabric exits the second drying zone, it is passed through a cooling zone prior to applying any substantial tension to the fabric to remove it from the process. In the embodiment shown in FIG. 1, the cooling zone comprises second vacuum source 8, which pulls ambient air through the fabric while it remains pinned to the belt in a substantially tensionless state. Other low tension cooling methods can be used, for example a cool air impingement process or light water spray. The fabric is cooled in the cooling zone to a sufficiently low temperature that tension can be applied to the fabric as it exits the belt without forming stretch-type defects, for example to wind up the fabric on a roll. For example, the fabric can be cooled to temperatures less than about $(T_m-30)°$ C., where $T_m$ is the melting or softening point of the lowest-melting (or only) polymeric component in the nonwoven fabric, in some cases to temperatures less than about $(T_m-40)°$ C. If the fabric is collected at low tension (e.g. less than about 52.5 N/m, preferably less than about 17.5 N/m) the fabric may be collected without cooling.

The drying process of the current invention can be conducted at high web speeds, for example greater than 150 yards/min (137 m/min). Preferably the line speed is greater than 225 yards/min (206 m/min), more preferably greater than 350 yardsiminute (320 m/min). Nonwoven fabrics that have been dried according to the process of the current invention preferably have a level of stretch-type defects less than 1 defect/yd$^2$ (1.2 defects/m$^2$), more preferably less than 0.5 defect/yd$^2$ (0.6 defect/m$^2$), and most preferably substantially zero defect/m$^2$.

TEST METHODS

In the description above and in the examples that follow, the following test methods were employed to determine various reported characteristics and properties. ASTM refers to the American Society for Testing and Materials.

Frazier Air Permeability is a measure of air flow passing through a sheet under at a stated pressure differential between the surfaces of the sheet and was conducted according to ASTM D 737, which is hereby incorporated by reference, and is reported in m$^3$/min/m$^2$.

The level of stretch-type defects was determined by visual examination with reflected light of an untensioned fabric sample cut to dimensions of 6 yd (5.5 meters) in the machine direction and 0.5 yd (0.46 m) in the cross-direction.

EXAMPLES

The nonwoven fabric used in the examples was a spunbond-meltblown-spunbond (SMS) composite nonwoven fabric having a basis weight of 1.8 oz/yd$^2$ (61.0 g/m$^2$). The spunbond layers were formed from bicomponent fibers having a sheath-core cross-section with linear low density polyethylene in the sheath (obtained from Equistar, melting point 125° C.) and poly(ethylene terephthalate) core (Crystar® 4449, available from DuPont). The meltblown layer comprised bicomponent fibers having a side-by-side cross-section made from linear low density polyethylene (Equistar, melting point 125° C.) and poly(ethylene terephthalate) (Crystar® 4449, available from DuPont). The ratio of polyester component to polyethylene component in the spunbond fibers was 50:50 by weight. The ratio of polyester component to polyethylene component in the meltblown fibers was 80:20 by weight.

Comparative Example A

This example demonstrates the effect of tension and temperature in a combined drying/curing process in which a SMS composite nonwoven fabric containing a chemical finish composition was dried and cured while under a tension of 0.3 lb./linear inch (52.5 N/m) or higher during the process. An aqueous finish containing 2.5 weight percent of a fluorochemical and 0.25 weight percent of an antistatic agent was applied to the SMS fabric using a dip-squeeze process that resulted in about 80 weight percent wet pick up of the finish, where wet pick up is defined as the weight percent of solvent (in this case water) in the fabric calculated based on the dry weight of the nonwoven fabric. The weight of solvent in the fabric was calculated by weighing a sample of the wet fabric, followed by drying the sample in an oven so as to remove substantially all of the water, weighing the dry fabric and subtracting the weight of the dry fabric from the weight of the wet fabric to obtain the weight of water. The SMS fabric was transported through a pilot-scale air-impingement flotation dryer manufactured by Megtec by pulling the fabric through the dryer using a set of 3 serpentine rolls equipped with a load cell to measure web tension in the machine direction. The tension on the fabric was adjusted by adjusting the relative speeds of the entrance roll (from which the SMS fabric was unwound prior to the dip-squeeze process) and the serpentine rolls. Air bars above and below the fabric supplied heated air and were adjusted such that the fabric floated as it was transported through the drier. The air velocity was set at 6000 fumin (1829 m/min). The dryer was divided into three sections. The first two of these sections were heated to the same temperature to substantially completely dry the fabric and the last section was heated to a second temperature to cure the fluorochemical. Ambient air was pulled through the fabric by vacuum after exiting the dryer to cool the fabric. Alcohol repellency measurements confirmed that the fluorochemical finish was cured after heating for the specified times at the specified temperatures. Drying and curing conditions and the number of stretch-type defects per square meter are reported in Table 1.

TABLE 1

Stretch-Type Defects as a Function of Drying/Curing Temperature and Tension for Complete Drying of LLDPE/PET SMS Fabric Under Tension

| Dry Temp (° C.) | Tension (N/m) | Dry Time (sec) | Cure Time (sec) | Cure Temp (° C.) | Defects (def/m$^2$) |
|---|---|---|---|---|---|
| 125 | 87.6 | 8 | 4 | 95 | 6 |
| 125 | 52.5 | 8 | 4 | 95 | 6 |
| 99 | 87.6 | 12 | 6 | 90 | 5 |
| 99 | 52.5 | 12 | 6 | 90 | 2.4 |

The results in Table 1 demonstrate that, when the SMS composite nonwoven fabric was dried and cured while under a tension of 52.5 N/m or higher, that stretch-type defects (appearing as puckers in the fabric) formed even when the highest temperature that the nonwoven fabric was heated to was approximately 26 degrees below the melting point of the lowest-melting polymeric component (linear low density polyethylene) and significantly below the melting point of the poly(ethylene terephthalate) component of the spunbond layer.

Examples 1-8

These examples demonstrate heat treatment of the SMS nonwoven fabric described in Comparative Example A in a process according to the current invention. The SMS fabric was topically treated with the same finish and transported through the same air-impingement flotation dryer described in Comparative Example A except that there was no heating in the third section of the dryer and the fabric exiting the air-impingement dryer had the moisture content indicated in Table 2. The air temperature in the first two drying sections was 115° C. with an air velocity of 8000 ft/min (2,438 m/min) with a drying residence time of 10 seconds. The tension applied during drying was approximately 0.5 lb./linear inch (87.6 N/m). For Examples 1-4, the entering water (moisture) content of the fabric was 80% WPU (wet pick up) which is 100×(weight of solvent/weight of dry fabric). For Examples 4-8 the entering moisture content was 100% WPU. The partially dried fabric was then deposited onto the belt of a through-air vacuum belt oven while at substantially the same moisture content as when the fabric exited the air-impingement flotation dryer. The fabric was pinned to the belt of the vacuum belt oven by pulling air heated to the cure temperature specified in Table 2 through the fabric by a vacuum source located below the belt. The water remaining in the fabric was evaporated followed by continued heating of the fabric to cure the fluorochemical finish. The fabric was passed through a short cooling section upon exiting the vacuum belt oven, where ambient air was pulled through the fabric after which the fabric was allowed to free-fall into a collecting container. Alcohol repellency measurements on the heat-treated fabric were similar to those obtained in Comparative Example A, confirming that the finish was cured.

TABLE 2

Stretch-Type Defects as a Function of Curing Temperature for Process According to Invention

| Example | Moisture @ Dryer Exit (wt %) | Cure Temp (° C.) | Air Velocity (m/min) | Cure Time (sec) | Defects (def/m$^2$) |
|---|---|---|---|---|---|
| 1 | 6% | 92 | 146 | 5 | 0 |
| 2 | 6% | 100 | 146 | 5 | 0 |
| 3 | 6% | 92 | 96 | 5 | 0 |
| 4 | 6% | 100 | 96 | 5 | 0 |
| 5 | 10% | 92 | 146 | 5 | 0 |
| 6 | 10% | 100 | 146 | 5 | 0 |
| 7 | 10% | 92 | 96 | 5 | 0 |
| 8 | 10% | 100 | 96 | 5 | 0 |

The results shown in Table 2 demonstrate that despite being partially dried at temperatures and tensions comparable to those of the comparative examples and heated to temperatures 25-33° C. below the melting temperature of the linear low density polyethylene component in a substantially tensionless condition, no stretch-type defects were formed in the fabrics that were heat-treated according to the process of the current invention.

The process and apparatus according to the present invention can be used to perform heat treatment, such as crystallization or crimping, on fabrics that may be sensitive to excessive tension.

What is claimed is:

1. A nonwoven fabric comprising fibers which comprise linear low density polyethylene, the nonwoven fabric having a chemical agent applied thereon and having a Frazier air permeability of at least 5 m$^3$/min/m$^2$ and characterized by less than 1.2 stretch-type defects/m$^2$.

2. The nonwoven fabric according to claim 1 wherein the fabric is characterized by less than 0.6 stretch-type defect/m$^2$.

3. The nonwoven fabric according to claim 2 wherein the fibers are bicomponent fibers.

4. The nonwoven fabric according to claim 3 wherein the bicomponent fibers further comprise polyester.

5. The nonwoven fabric according to claim 4 wherein the bicomponent fibers are arranged in a sheath-core configuration, the sheath comprising linear low density polyethylene and the core comprising polyester.

6. The nonwoven fabric according to claim 1 wherein the chemical agent is a cured fluorochemical.

7. The nonwoven fabric according to claim 1, wherein said fibers are spunbond fibers.

* * * * *